US006483061B1

(12) United States Patent
Harvey et al.

(10) Patent No.: US 6,483,061 B1
(45) Date of Patent: Nov. 19, 2002

(54) TRIPLE POLE SAFETY SWITCH AND CONNECTOR

(75) Inventors: Arthur James Harvey, Mantua, OH (US); Michael Eric Liedtke, Massillon, OH (US); Jay Dean Atkinson, Cambridge, OH (US)

(73) Assignee: Delta Systems, Inc., Streetsboro, OH (US)

( * ) Notice: Subject to any disclaimer, the term of this patent is extended or adjusted under 35 U.S.C. 154(b) by 0 days.

(21) Appl. No.: 09/960,539

(22) Filed: Sep. 21, 2001

(51) Int. Cl.[7] ..... H01H 9/00; H01H 13/36; H01R 13/70

(52) U.S. Cl. ..... 200/532; 200/51 R; 200/5 R; 200/16 B; 200/530; 200/531

(58) Field of Search ..... 200/4, 5 R, 11 R, 200/16 A, 16 B, 16 E, 16 F, 17 R, 18, 51 R–51, 17, 520–536, 243, 260, 276, 276.1, 283, 284, 307, 314

(56) References Cited

U.S. PATENT DOCUMENTS

| | | | | |
|---|---|---|---|---|
| 3,860,775 A | * | 1/1975 | Koepke | 200/531 |
| 4,795,865 A | | 1/1989 | Howard | |
| 4,812,604 A | | 3/1989 | Howard | |
| 4,839,478 A | | 6/1989 | Howard | |
| 4,885,438 A | * | 12/1989 | Tajima | 200/51.09 |
| 4,924,046 A | | 5/1990 | Howard | |
| 5,063,277 A | * | 11/1991 | Takano et al. | 200/531 |
| 5,190,148 A | | 3/1993 | Williams | |
| 5,221,816 A | | 6/1993 | Williams | |
| 5,252,791 A | | 10/1993 | Williams | |
| 5,424,502 A | | 6/1995 | Williams | |
| 5,528,007 A | | 6/1996 | Williams et al. | |
| 5,548,888 A | | 8/1996 | Williams | |
| 5,613,598 A | | 3/1997 | Pittman et al. | |
| 5,662,213 A | | 9/1997 | Kattler et al. | |
| 5,756,947 A | | 5/1998 | Trimble, Jr. et al. | |
| 5,775,482 A | | 7/1998 | Wolfe et al. | |
| 6,207,910 B1 | | 3/2001 | Harvey et al. | |

* cited by examiner

*Primary Examiner*—J. R. Scott
(74) *Attorney, Agent, or Firm*—Watts, Hoffmann, Fisher & Heinke Co.

(57) ABSTRACT

The present invention is directed to three pole plunger switch assembly. The assembly includes a three pole plunger switch and a mating connector. The plunger switch includes a switch housing for supporting components of the plunger switch and a plunger extending into an interior region of the switch housing and being actuatable from outside the switch housing wherein the plunger adapted to move between a normal position and an actuated position. The plunger switch further includes first, second and third electrically conductive wiper contacts mounted to the plunger for movement with the plunger and first, second and third sets of terminals extending into the switch housing interior region. Respective terminals of the first and second terminal sets are substantially aligned. The terminals of the third terminal set are perpendicular to the terminals of the first and second terminal sets. The connector includes a connector housing that is releasably engages the switch housing and first, second and third sets of terminals supported by the connector housing in spaced apart relationship and oriented to electrically contact the terminals of the first, second and third sets of terminals of the plunger switch when the plunger switch housing and the connector housing are engaged.

39 Claims, 4 Drawing Sheets

TRIPLE POLE SAFETY SWITCH AND CONNECTOR

FIELD OF THE INVENTION

The present invention is directed to a three pole safety switch and a mating connector and, more specifically, to a three pole, plunger switch having a terminal configuration that insures proper alignment of the plunger switch and the mating connector during mechanical connection.

BACKGROUND ART

Plunger switches are widely utilized in many diverse applications including use as safety switches in various motorized devices. For example, U.S. Pat. No. 5,424,502, issued Jul. 27, 1993 to Williams, entitled QUICK-INSTALL SEAT SWITCH and assigned to the assignee of the present invention discloses a plunger switch and quick install mounting assembly for mounting the plunger switch on a rigid seat pan of a garden or lawn tractor. The '502 patent is incorporated herein in its entirety by reference. The switch assembly disclosed in the '502 patent is a single pole plunger switch. The switch has two terminal contacts, the plunger switch electrically coupling or decoupling the two terminals depending upon the plunger or actuator position. The mounting assembly of the '502 patent allows the plunger switch to be connected to the seat pan such that the actuator of a switch installed on a seat pan extends above the seat pan and the switch housing is below the seat pan.

In the mounting assembly disclosed in the '502 patent, a cover overlies the actuator. When the operator is seated on the seat cushion, the cover is forced downward by the deflection of the seat cushion thereby depressing the actuator from its first undepressed position to a second depressed position. If the switch assembly is a normally closed switch (i.e., the terminals are electrically coupled by the actuator when the actuator is in its first undepressed position) and the switch assembly terminals are electrically coupled between the tractor engine magneto and an electrical ground of the tractor, the tractor engine is shut off if the operator steps (or falls) off of the tractor seat. That is, the actuator would return to its first undepressed position when the seat is unoccupied, thereby closing the electrical connection between the magneto and electrical ground, resulting in the magneto being grounded out and stalling the engine.

With additional switches and/or relays appropriately mounted and connected, more sophisticated safety functions can be accomplished. For example, the engine may be shut off only if the operator is not sitting on the seat and the tractor's mowing blade and/or power take off is engaged. U.S. Pat. No. 5,190,019, issued Mar. 2, 1993 and entitled INTERLOCK CIRCUIT FOR DE-ACTIVATING AN ENGINE, also assigned to the assignee of the present invention discloses such a circuit. The '019 patent is incorporated herein in its entirety by reference.

While the tractor seat pan mounted plunger-type safety switch disclosed in '502 patent provided a securely mounted switch that was easy to mount, such a switch (and other such prior art seat mounted safety switches) provided only a single circuit (one pole) switch. Additional operational fail-safe safety functions on lawn and garden tractors and riding lawn mowers, such as turning the engine off if the cutting blade is engaged and the tractor is shifted into reverse are desirable. Such additional safety functions create a need for a safety switch having more than one pole, thereby avoiding the necessity of duplicate switches and/or relays. Because of limited mounting room below the seat pan, it is desirable that the switch housing and connector be configured to minimize the height of the assembly extending below the seat pan, that is, along an axis of movement of the actuator. Additionally, it is desirable to prevent an operator from bypassing the operation of the safety functions provided by a seat mounted safety switch by simply disengaging the connector coupled to the switch housing.

SUMMARY OF THE INVENTION

The present invention is directed to a three pole plunger switch assembly. The assembly includes a three pole plunger switch and a mating connector. The plunger switch includes a switch housing for supporting components of the plunger switch and a plunger extending into an interior region of the switch housing. The plunger is actuatable from outside the switch housing wherein the plunger is adapted to move between a normal position and an actuated position. The plunger switch includes first, second and third electrically conductive wiper contacts mounted to the plunger for movement with the plunger. First, second and third sets of terminals extend into the switch housing interior region. The first set of terminals includes a first terminal and a second terminal which are electrically coupled by engagement of the first wiper contact in one of the normal and actuated positions of the plunger. The second set of terminals including a third terminal and a fourth terminal which are electrically coupled by engagement of the second wiper contact in one of the normal and actuated positions of the plunger. The third set of terminals including a fifth terminal and a sixth terminal which are electrically coupled by engagement of the third wiper contact in one of the normal and actuated positions of the plunger.

The first, second, third and fourth terminals include outer surface portions that are substantially parallel. The outer surface portions of the first and third terminals are substantially aligned and the outer surface portions of the second and fourth terminals are substantially aligned. The fifth and sixth terminals include outer surface portions that are substantially parallel and transverse to the outer surface portions of the first, second, third and fourth terminals. In one embodiment of the assembly, the fifth and sixth terminal outer surface portions are perpendicular to the outer surface portions of the first, second, third and fourth terminals.

The mating connector includes a connector housing that supports first, second and third sets of terminals. The connector terminals are supported in spaced apart relationship and oriented to electrically connect to the terminals of the first, second and third sets of terminals of the plunger switch when the plunger switch housing and the connector housing are engaged.

Such a three pole terminal configuration of the plunger switch has several advantages. The terminal configuration facilitates use of a single plunger with three support members to support three conductive wiper contacts. The positioning of the three wiper contacts and the three respective sets of terminals provide three wiper contacts paths of travel as the plunger is moved from its normal position to its actuated position. The path of travel of each wiper contact intersects respective pairs of terminals to selectively electrically couple or bridge the pair of terminals comprising each set of terminals in one of either the actuated or normal positions of the plunger.

A set of terminals may be normally open or normally closed. If a set of terminals is normally closed, the wiper contact associated with the terminals bridges the terminals when the plunger is in the normal position and does not bridge the terminals when the plunger is in the actuated position. If a set of terminal is normally open, the wiper contact associated with the terminals bridges the terminals when the plunger is in the actuated position and does not bridge the terminals when the plunger is in the normal position. Advantageously, the plunger wiper support members facilitate two wiper contact mounting positions. The first mounting position is utilized for normally closed terminals and the second mounting position is utilized for normally open terminals.

Another advantage of the terminal configuration of the present invention is that the configuration of the connector and the switch housing terminals prevents engagement of the connector housing and the switch housing in an improper orientation.

These and other objects, advantages and features of the invention will become better understood from a detailed description of an exemplary embodiment of the invention which is described in conjunction with the accompanying drawings.

BEST MODE FOR PRACTICING THE INVENTION

The present disclosure is directed to a multiple pole plunger switch assembly 10. The multiple pole plunger switch assembly 10 includes a multiple pole plunger switch 12 and a mating connector 14. In the illustrated embodiment, the multiple pole plunger switch 12 is a three pole plunger switch. The plunger switch 12 of the illustrated embodiment may be used to control operation of one or more components or assemblies of a vehicle such as a riding lawn mower or lawn and garden tractor. For example, the plunger switch may be used to control the vehicle's engine, the vehicle's lights, and/or implement drive such as a power taken off drive shaft. In the exemplary embodiment, the plunger switch controls operation of such vehicle component by selectively electrically bridging or not bridging three electrical circuits (one pole for each circuit) of the vehicle.

Figures 1, 2:
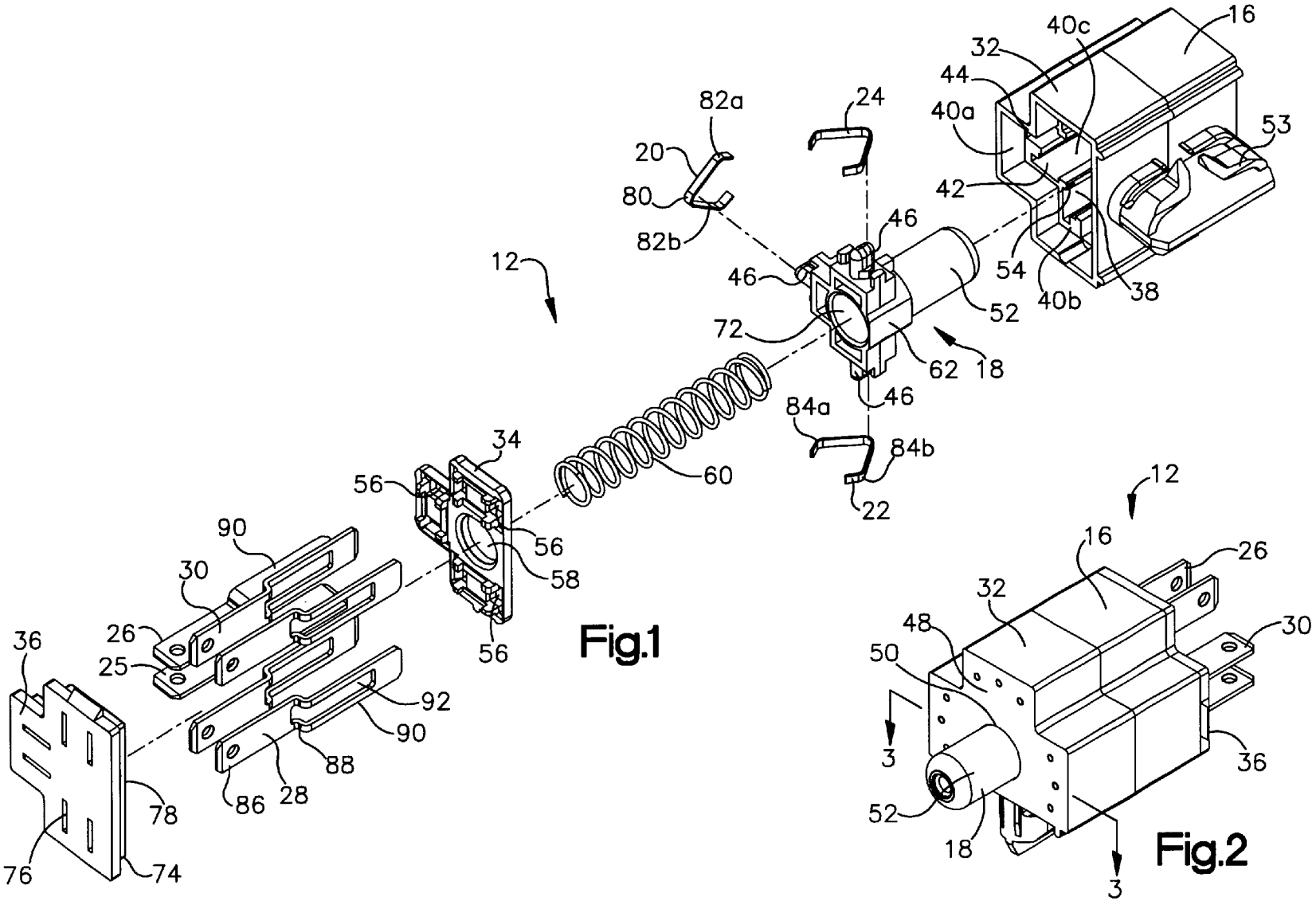
FIG. 1 is an exploded perspective view of a three pole plunger switch.
FIG. 2 is a perspective view of the three pole plunger switch of FIG. 1.

As can best be seen in FIG. 1, the illustrated plunger switch 12 includes a housing 16, a plunger 18, first, second and third contacts 20, 22, 24 which in the exemplary embodiment are flatwire wipers or pairs of contacts and first, second and third flat wire wipers or pairs of terminals 26, 28, 30.

Figure 8:
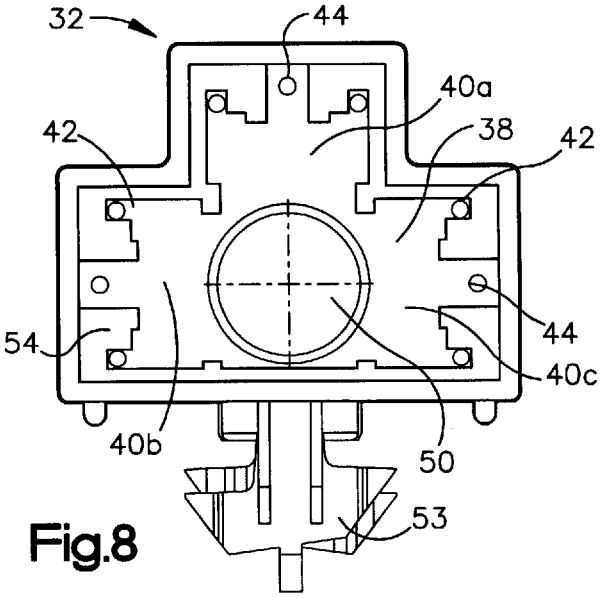

In the exemplary embodiment, the switch housing 16 includes a nonconductive housing body 32, a nonconductive terminal guide 34 and a nonconductive bottom or back cover 36. Preferably, the housing body 32 is fabricated of polypropylene, the terminal guide 34 is fabricated of polypropylene, the back cover 36 is fabricated of polypropylene, and the plunger 28 is fabricated of polypropylene. Referring to FIGS. 1 and 8, the housing body 32 defines an interior compartment 38 that, in the illustrated embodiment, defines three channels 40*a*, 40*b*, 40*c*. Each channel corresponds to a pair of terminals 26, 28, 30 and a corresponding contact 20, 22, 24. Preferably, the terminal pairs 26, 28, 30 are fabricated of brass, and the contacts 20, 22, 24 are fabricated of phosphorous bronze. Each of the channels 40*a*, 40*b*, 40*c* define a pair of spaced apart slots 42. The slots 42 are each sized to accept and position a terminal within the housing body 32. The slots 42 maintain the pairs of terminals 26, 28, 30 in a spaced apart relationship. Each channel 40*a*, 40*b*, 40*c* also defines a slot 44 that is slightly larger than outwardly extending protrusions 46 of the plunger 18. When a plunger 18 is installed in the housing body 32, the fit of the respective protrusions 46 in the slots 44 maintains the orientation of the plunger 18 within the housing. It should be readily apparent to those skilled in the art that the illustrated plunger switch housing 16 of the present invention may be modified to include four channels corresponding to four pairs of terminals by adding a fourth channel to the housing.

In the exemplary embodiment, the interior compartment 38 defines channels 40 that are orthogonal to one another. By defining channels 40 that are orthogonal to one another in the interior compartment 38 of the housing 32, a three (or four) pole switch may be constructed that occupies a very small volume.

The illustrated housing body 32 includes an upper surface 48 that includes an opening 50 (FIG. 2). The opening 50 is sized to accept a post 52 of the plunger 18. In the illustrated embodiment, the opening 50 is circular corresponding to a circular plunger post 52.

The illustrated housing body 32 includes a snap-in mount 53 that allows the switch 12 to be mounted to a panel, such as a rigid seat pan of a garden tractor. One acceptable snap-in mount is disclosed in U.S. Pat. No. 5,775,482 to Wolf et al., issued Jul. 7, 1998, which is incorporated herein by reference in its entirety.

The terminal guide 34 is sized to fit within the internal compartment 38 of the housing 32. When assembled in the switch housing body 32, the terminal guide 34 rests on a shelf 54 defined by ends of walls that define the terminal slots 42 and plunger protrusion slots 44. The terminal guide 34 includes slots 56 that correspond to the slots 42 in the interior compartment 38 of the housing 32. The slots 56 help to align the terminals with the slots 42 in the housing 32 as the switch 12 is being assembled. The terminal guide 34 also includes an opening 58 that is sized to fit around a biasing spring 60. The spring 60 biases the plunger 18 to its normal, undepressed position. The opening 58 in the terminal guide 34 helps to maintain the position of the biasing spring 60 against the back cover 36. The terminal guide makes the switch 12 easier to assemble. Although the guide 34 aids assembly, it should be readily apparent to those skilled in the art that the terminal guide can be eliminated from the illustrated switch.

Figure 5:
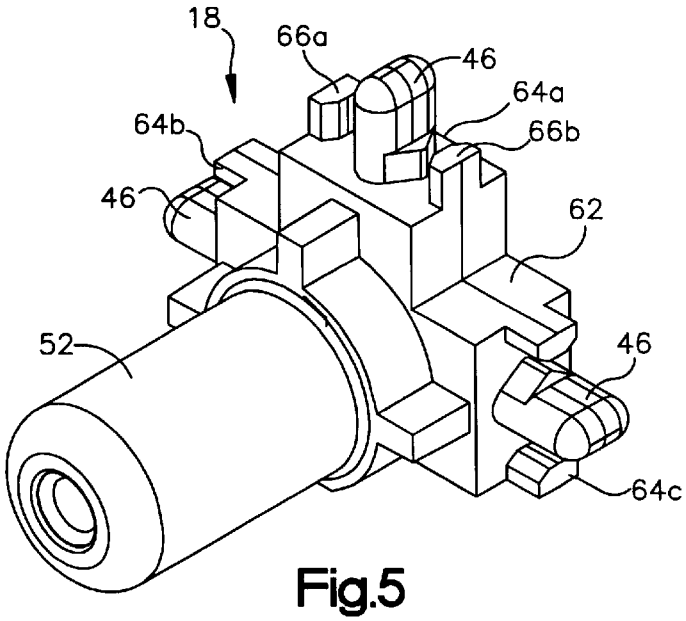
FIG. 5 is a perspective view of a plunger of the three pole plunger switch.
Figure 7:
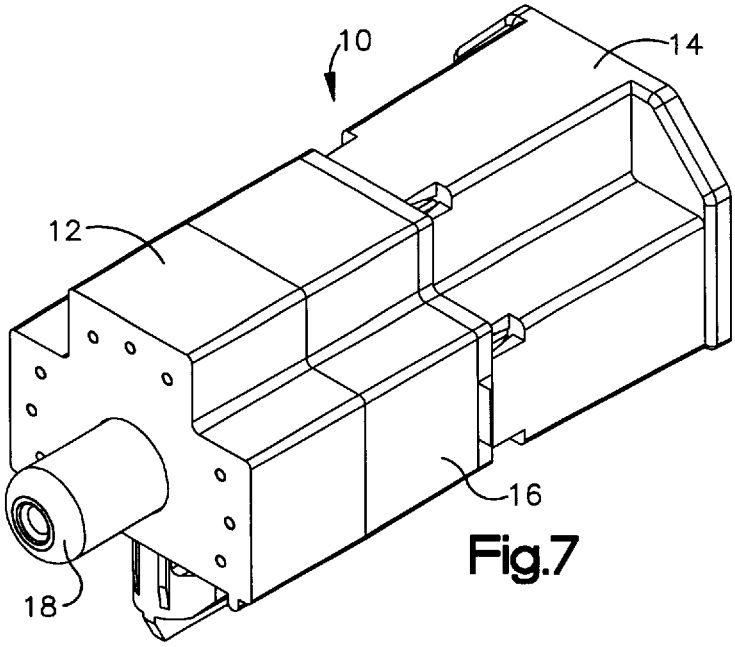
FIG. 7 is a three pole plunger switch assembly including the three pole plunger switch and the mating connector; and, FIG. 8 is a front elevational view of a housing of the three pole plunger switch.

Referring to FIGS. 1 and 5, the plunger 18 includes a post 52 that extends through the opening 50 in the housing 32 and an end 62 that resides within the interior compartment 38 of the housing 32. In the illustrated embodiment, the post 52 is cylindrical corresponding to the circular opening 50 in the upper surface 48 of the housing 32.

Referring to FIG. 5, the illustrated interior end 62 of the plunger 18 includes three flat wire contact mounts 64*a*, 64*b*, 64*c*. In the exemplary embodiment, the mounts 64*a*, 64*b*, 64*c* are oriented orthogonally with respect to one another. Each of the mounts 64*a*, 64*b*, 64*c* include the central protrusion 46 and two outer protrusions 66*a*, 66*b* flanking the respective central protrusions. The central protrusion 46 and the outer protrusions 66*a*, 66*b* hole the contacts 20, 22, 24 on the end 62 of the plunger 18. Referring to FIGS. 3A, 3B, 4A and 4B, the three central protrusions 46 and the respective outer protrusions 66*a*, 66*b* are configured such that the wipers or contacts 20, 22, 24 may be selectively installed on the plunger end 62 in man upright orientation (shown in FIGS. 3A and 3B) or an inverted orientation (shown in FIGS. 4A and 4B) depending on whether a desired terminal pair configuration is to be normally open or normally closed. If a normally closed terminal configuration is desired, the corresponding wiper will be in the inverted position. Referring to FIG. 4A, a contact installed in an inverted orientation of a contact 22 corresponds to a switch pole that is normally closed. Referring to FIG. 3A, a contact installed in an upright orientation of a contact 20, corresponds to a pole that is normally open.

Each of the mounts 64*a*, 64*b*, 64*c* is sized to fit within a channel 40 in the interior compartment of the housing 32. The central protrusion 46 of each mount 64*a*, 64*b*, 64*c* fits within a slot 44 in the interior compartment 38 of the housing 32. The mounts 64*a*, 64*b*, 64*c* guide the plunger 18 along the channels 40 when the plunger 18 is depressed and when the plunger is brought back to the normal position by the biasing force of the spring 60.

The interior end 62 of the plunger 18 includes a cylindrical cavity 72 that is sized to accept the biasing spring 60. In the illustrated embodiment, the cavity 72 is a round opening that is slightly larger than the outer diameter of the spring 60. The cavity 72 constrains the spring 60 within the housing 32.

The bottom or back cover 36 is sized to cover the interior compartment 38 of the housing 32. The back cover 36 includes a step 74 that extends into the interior compartment when the back cover 36 is assembled to the housing body 32. The back cover 36 includes slots 76 that are sized to accept the pairs of terminals 26, 28, 30. In the illustrated embodiment, the pairs of terminals, 26, 28, 30 include an offset 88 (FIG. 1) that prevents the pairs of terminals 26, 28, 30 from being pulled through the slots 76 of the cover 36. The biasing spring 60 presses against an inner surface 78 of the back cover 36 to bias the plunger 18 to the normal position.

In the illustrated embodiment, the contacts 20, 22, 24 are flat wire contacts. In the exemplary embodiment, the contacts include a curved or bent middle portion 80 and two legs 82*a*, 82*b* that extend from the middle portion 80. In the illustrated embodiment, the legs 82 are bent inward at their ends to form rounded contact portions 84*a*, 84*b* near the ends of the legs. While the illustrated contacts are substantially V-shaped, one skilled in the art would recognize that the contacts may have other configurations, e.g., U-shaped. A contact associated with a normally closed pole is mounted to a mount in an inverted orientation (contacts 22, 24 in the illustrated embodiment). A contact associated with a normally open terminal is mounted to a plunger mount 64 in an inverted orientation (contact 20 in the illustrated embodiment).

Referring to FIG. 1, each of the terminals 25 of the first, second and third pairs of terminals 26, 28, 30 is a flat wire conductive metal terminal. However, a round wire contact could also be used. In the illustrated embodiment, each terminal 25 includes a connecting portion 86, an off-set 88 and a contacting portion 90. In the illustrated embodiment, the connecting portion 86 extends out of the switch housing 16 through the back cover 36. One acceptable connecting portion is 0.032 inches thick by 0.250 inches wide. The off-set 88 of each terminal 25 is captured between the terminal guide 34 and the back cover. The terminal guide 34 and the back cover 36 maintain the correct spacing between the terminals 25 as the terminals 25 are assembled into the housing 32.

The contacting portion 90 of each terminal 26, 28, 30 extends into and is constrained by a terminal slot 42 in the interior compartment 38 of the housing 32. In the exemplary embodiment, a normally closed terminal includes a contacting portion with a cut-out or opening 92 and a normally open contact includes a connecting portion that does not include such a cut-out or opening. However, in one embodiment a normally open pole uses the same terminal 26, 28, 30 that is used for the normally closed poles (i.e., a terminal having an opening 92). A normally closed pole and a normally open pole may utilize the same terminals 25 including a contacting portion having an opening 92, since the normal undepressed state of the switch is determined by the orientation of the contact.

Referring to FIGS. 3A and 4A, the spring 60 (not shown in FIG. 4A) biases the plunger 18 to the normal position. Referring to FIGS. 3A and 4A, a pair of terminals (pairs of terminals 28, 30 in the illustrated embodiment) associated with a normally closed pole are electrically connected by a contact in the normal position. The terminals of a normally closed pole are electrically connected by a contact (contacts 22, 24 in the illustrated embodiment) in an inverted orientation. Also in the normal position, the terminals (pair of terminals 26) associated with a normally open pole are not electrically connected by a contact. Referring to FIG. 3A, a contact (contact 20 in the illustrated embodiment) associated with a normally open pole is in an upright orientation and thus does not contact the pair of terminals 26 of the normally open pole.

Figure 3B:
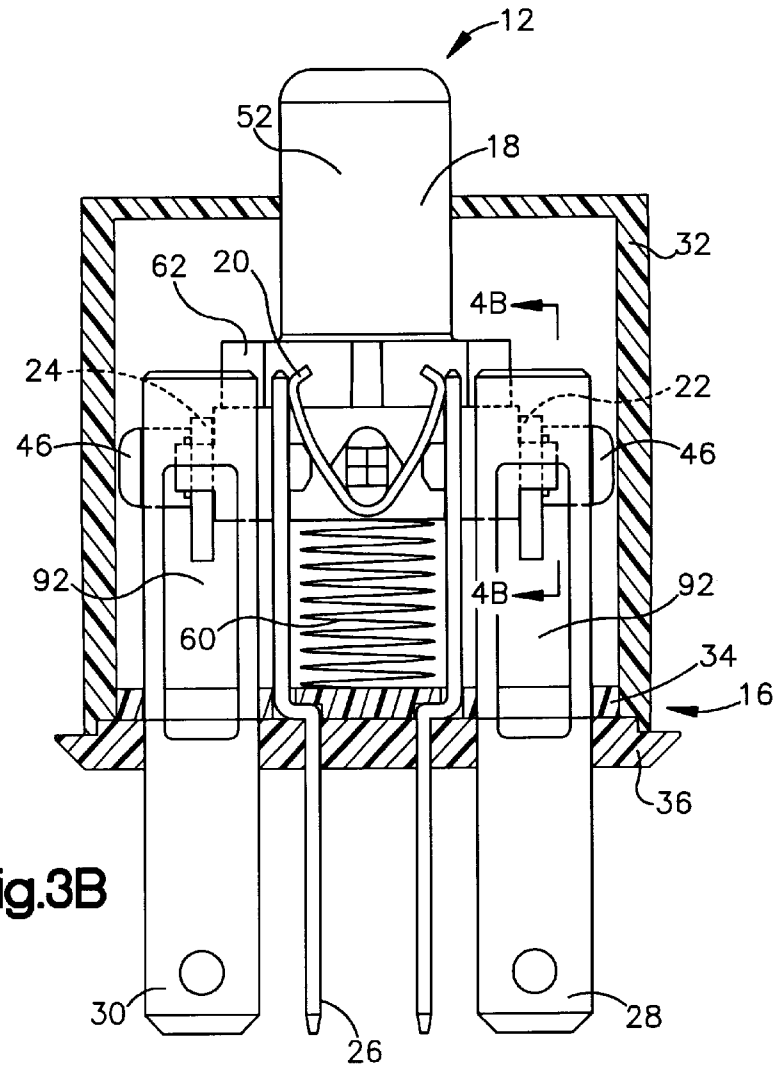
FIG. 3B is a section view as seen from a plane indicated by the lines 3—3 of FIG. 2 showing the three pole plunger switch in an actuated position.
Figure 3A:
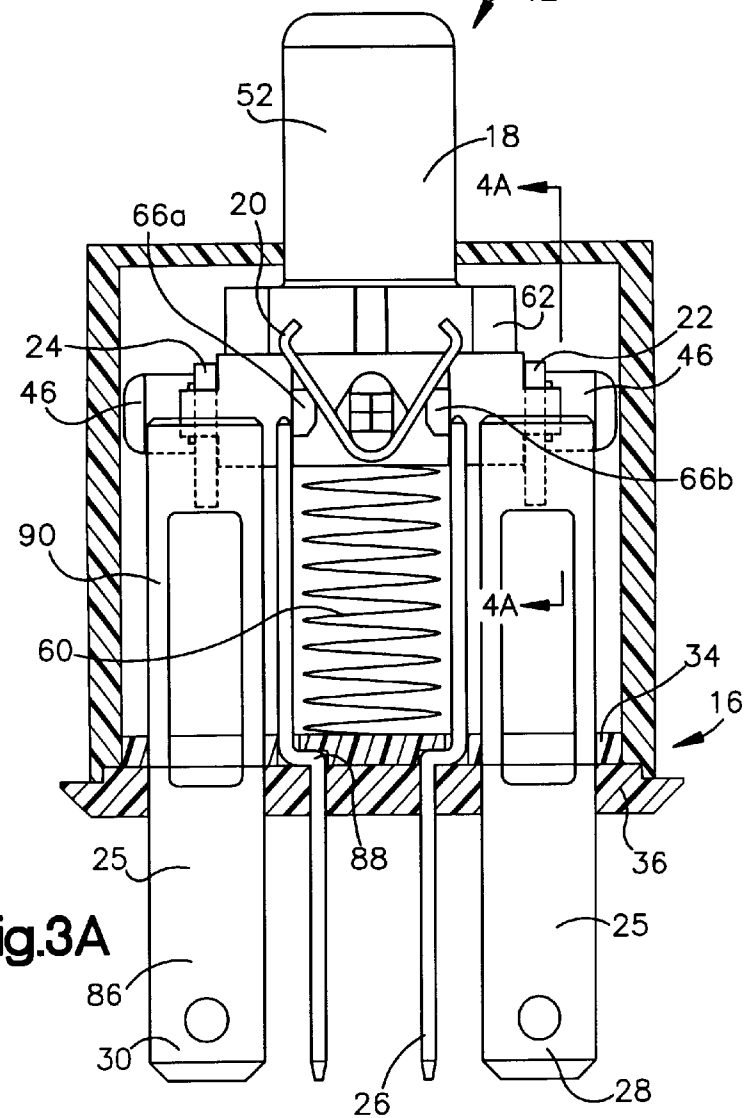
FIG. 3A is a section view as seen from a plane indicated by the lines 3—3 of FIG. 2 showing the three pole plunger switch in a normal position.
Figure 4A:
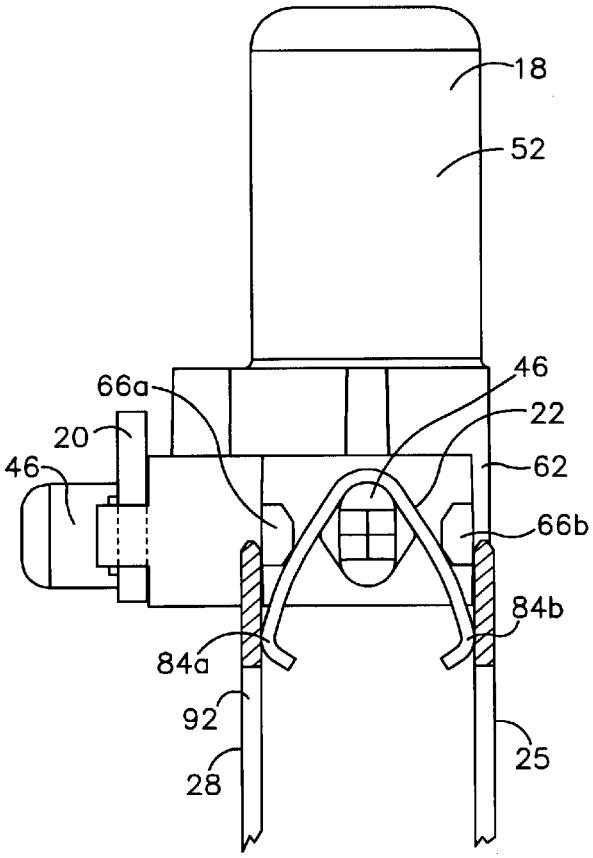
FIG. 4A is a view as seen from a plane indicated by the lines 4A—4A of FIG. 3A.
Figure 4B:
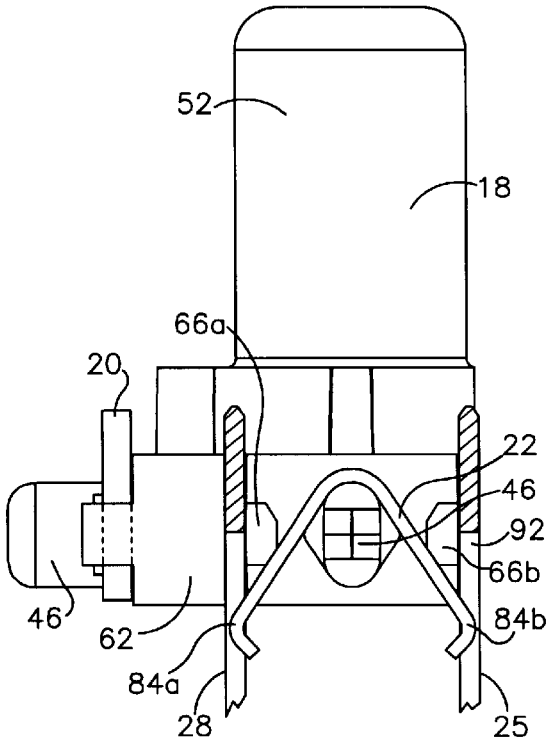
FIG. 4B is a view as seen from a plane indicated by the lines 4B—4B of FIG. 3B.

FIGS. 3B and 4B illustrate one embodiment of the plunger switch 12 biased against the force of the spring 60 to an inverted actuated position. In the actuated position, a normally closed pole is open. The plunger moves the inverted contact (contacts 22, 24 in the illustrated embodiment) downward in the housing 16, such that the contact portions 84*a*, 84*b* of the contact extend into the opening 92 in the terminals 25 and, thus, do not electrically connect the terminals 25 of the normally closed pole.

Referring to FIG. 3B, the normally open pole is closed in the actuated position. The contact (contact 20 in the illustrated embodiment) in the upright orientation is moved downward by the plunger 18 to bring the contact portions 84*a*, 84*b* into engagement with a pair of terminals (terminals 26 in the illustrated embodiment) associated with the normally open pole.

Figure 6A:
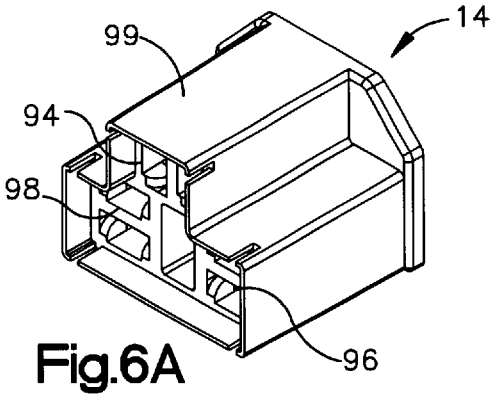
FIG. 6A is a perspective view of a mating connector for the three pole plunger switch.
Figure 6B:
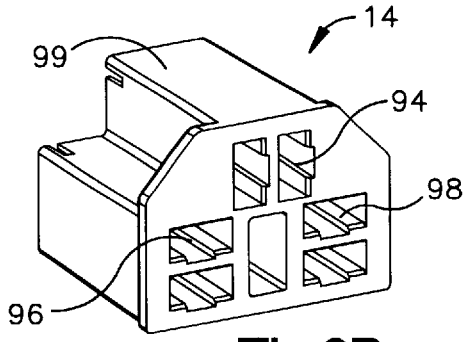
FIG. 6B is a second perspective view of the mating connector of FIG. 6A.

Referring to FIGS. 6A and 6B, the mating connector 14 includes first, second and third pairs of mating female terminals 94, 96, 98 installed in a connector housing 99. In the exemplary embodiment, the housing 99 is constructed from polypropylene. In the illustrated embodiment, the connector housing 99 maintains mating female terminals pairs 94, 96, 98 in an orthogonal relationship to one another, corresponding to the first, second and third pairs 26, 28, 30 of male switch terminals. The mating terminal pairs 94, 96, 98 of the mating connecting 14 are simultaneously brought into engagement with the pairs of terminals of the plunger switch 12 when the mating connector 14 is assembled to the plunger switch 12. The orthogonal orientation of the male terminal 25 of the plunger switch 12 and mating terminals 94, 96, 98 of the connector 14 prevent a male terminal of the switch 12 from being connected to an incorrect female terminal of the connector 14 circuit. That is, the connector housing 99 and the switch housing 16 can be coupled in only one orientation, thereby insuring that the appropriate pairs of male terminals of the switch 12 are electrically coupled to the proper corresponding female terminals of the connector 14.

While the present invention has been described with a degree of particularity, it is the intent that the invention include all modifications and alterations from the disclosed embodiments falling within the spirit or scope of the appended claims.

We claim:

1. A multiple pole switch apparatus comprising:

a) a switch housing defining a housing interior having an access opening that extends through a wall of said housing to the housing interior;

b) a plunger constrained by said housing to translate along a path including a normal position and an actuated position, said plunger has an actuating portion that extends outwardly from the housing interior through the access opening and a plunger body disposed inside the housing;

c) first and second contact portions constrained by said plunger body to move with said plunger as said plunger moves along said path;

d) a first pair of terminals extending into said housing and positioned such that said first contact portion selectively engages said first pair of terminals when said plunger is moved between said normal position and said actuated position; and e) a second pair of terminals positioned generally perpendicular to said first pair of terminals extending into said housing, said second pair of terminals are selectively engaged by said second contact portion when said plunger is moved between said normal position and said actuated position.

2. The apparatus of claim 1 wherein said second contact portion is inverted with respect to said first contact portion.

3. The apparatus of claim 2 wherein each of said terminals of said first pair include a cutout, said first pair of terminals being positioned such that said first contact portion engages said first pair of terminals when said plunger is in said normal position and said first contact portion extends through said cutouts when said plunger is in said actuated position, said second pair of terminals are positioned such that the second pair of terminals are engaged by said second inverted contact portion when said plunger is in said actuated position.

4. The apparatus of claim 1 wherein said plunger includes a first surface and a second surface that is generally perpendicular to said first surface, said first contact portion being constrained by said first surface and said second contact portion being constrained by said second surface to move with said plunger along said path.

5. The apparatus of claim 1 wherein said plunger body includes a first contact constraint and a second contact constraint that is generally perpendicular to said first contact constraint, said first and second contact constraints including a post and a pair of spaced apart leg contacting members.

6. A multiple pole switch apparatus comprising:

a) a switch housing defining a housing interior having an access opening that extends through a wall of said housing to the housing interior;

b) a plunger constrained by said housing to translate along a path including a normal position and an actuated position, said plunger has an actuating portion that extends outwardly from the housing interior through the access opening and a plunger body disposed inside the housing, said plunger body including a first surface and a second surface that is generally perpendicular to said first surface;

c) a first contact constrained by said first surface to move with said plunger as said plunger moves along said path;

d) a second contact constrained by said second surface to move with said plunger along said path;

e) a first pair of terminals extending into said housing and positioned such that said first contact selectively engages said first pair of terminals when said plunger is moved between said normal position and said actuated position; and f) a second pair of terminals extending into said housing and positioned generally perpendicular to said first pair of terminals, said second pair of terminals are selectively engaged by said second contact when said plunger is moved between said normal position and said actuated position.

7. The apparatus of claim 6 wherein said second contact is inverted with respect to said first contact.

8. The apparatus of claim 7 wherein each of said terminals of said first pair include a cutout, said first pair of terminals being positioned such that said first contact engages said first pair of terminals when said plunger is in said normal position and said first contact extends through said cutouts when said plunger is in said actuated position, said second pair of terminals are positioned such that the second pair of terminals are engaged by said second inverted contact when said plunger is in said actuated position.

9. The apparatus of claim 6 wherein a first contact constraint extends from said first surface and a second contact constraint extends from said second surface, said first and second contact constraints including a post and a pair of spaced apart leg contacting members.

10. A multiple pole switch apparatus comprising:

a) a switch housing defining a housing interior having an access opening that extends through a wall of said housing to the housing interior;

b) a plunger constrained by said housing to translate along a path including a normal position and an actuated position, said plunger has an actuating portion that extends outwardly from the housing interior through the access opening and a plunger body disposed inside the housing;

c) first and second contacts constrained by said plunger body to move with said plunger as said plunger moves along said path, said second contact being inverted with respect to said first contact;

d) a first pair of terminals extending into said housing and positioned such that said first contact selectively engages said first pair of terminals when said plunger is moved between said normal position and said actuated position; and e) a second pair of terminals extending into said housing, said second pair of terminals are selectively engaged by said second contact when said plunger is moved between said normal position and said actuated position and said second pair of terminals being generally perpendicular to said first pair of terminals.

11. The multiple pole switch apparatus of claim 10 wherein the first and second sets of terminals extend though openings in a terminal guide positioned in the interior region of the switch housing.

12. The apparatus of claim 10 wherein said first contact is oriented generally perpendicular to said first contact.

13. The apparatus of claim 10 wherein each of said terminals of said first pair include a cutout, said first pair of terminals being positioned such that said first contact engages said first pair of terminals when said plunger is in said normal position and said first contact extends through said cutouts when said plunger is in said actuated position, said second pair of terminals are positioned such that the second pair of terminals are engaged by said second inverted contact when said plunger is in said actuated position.

14. The apparatus of claim 10 wherein said plunger includes a first surface and a second surface that is generally perpendicular to said first surface, said first contact being constrained by said first surface and said second contact being constrained by said second surface to move with said plunger along said path.

15. The apparatus of claim 10 wherein said plunger body includes a first contact constraint and a second contact constraint that is generally perpendicular to said first contact constraint, said first and second contact constraints including a post and a pair of spaced apart leg contacting members.

16. A multiple pole switch apparatus comprising:

a) a switch housing defining a housing interior having an access opening that extends through a wall of said housing to the housing interior;

b) a plunger constrained by said housing to translate along a path including a normal position and an actuated position, said plunger has an actuating portion that extends outwardly from the housing interior through the access opening and a plunger body disposed inside the housing, said plunger body including a first contact constraint and a second contact constraint that is generally perpendicular to said first contact constraint, said first and second contact constraints including a post and a pair of spaced apart leg contacting members;

c) a spring constrained by said plunger and said housing that biases said plunger to said normal position;

d) a first conductive leaf spring contact formed from a flat metal strip constrained by said first constraint to move with said plunger as said plunger moves along said path;

e) a second conductive leaf spring contact formed from a flat metal strip constrained by said second constraint to move with said plunger along said path, said second conductive leaf spring being inverted with respect to said first contact;

f) a first pair of terminals extending into said housing, each of said terminals of said first pair including a cutout, said first pair of terminals being positioned such that said first contact engages said first pair of terminals when said plunger is in said normal position and said first contact extends through said cutouts when said plunger is in said actuated position; and g) a second pair of terminals extending into said housing and positioned generally perpendicular to said first pair of terminals, said second pair of terminals are positioned such that the second pair of terminals are engaged by said second inverted contact when said plunger is in said actuated position.

17. A plunger switch connector assembly comprising:

a) a switch including a plunger movable in a switch housing between a normal position and an actuated position to selectively move first and second contact portions into engagement with first and second pairs of male terminals that extend from a surface of said housing, said first pair of male terminals being positioned substantially perpendicular to said second pair of male terminals; and b) a mating connector including first and second pairs of female terminals positioned within a connector housing corresponding to said first and second pairs of male terminals, said first pair of female terminals being positioned substantially perpendicular to said second pair of female terminals.

18. A plunger switch connector assembly comprising:

a) a switch including a plunger movable in a switch housing between a normal position and an actuated position to selectively move first, second and third contact portions into engagement with first, second and third pairs of male terminals that extend from a surface of said housing, said first and second pairs of male terminals being substantially parallel, said third pair of male terminals being positioned substantially perpendicular to said first and second pairs of male terminals; and b) a mating connector including first, second and third pairs of female terminals positioned within a connector housing corresponding to said first, second and third pairs of male terminals.

19. A plunger switch comprising:

a) a switch housing for supporting components of the plunger switch;

b) a plunger extending into an interior region of the switch housing and being actuatable from outside the switch housing, the plunger adapted to move between a normal position and an actuated position;

c) first, second and third electrically conductive wiper contacts mounted to the plunger for movement with the plunger;

d) first, second and third sets of terminals extending into the switch housing interior region, the first set of terminals including a first terminal and a second terminal which are electrically coupled by engagement of the first wiper contact in one of the normal and actuated positions of the plunger, the second set of terminals including a third terminal and a fourth terminal which are electrically coupled by engagement of the second wiper contact in one of the normal and actuated positions of the plunger and the third set of terminals including a fifth terminal and a sixth terminal which are electrically coupled by engagement of the third wiper contact in one of the normal and actuated positions of the plunger; and e) the first and second terminals of the first terminal set and the third and fourth terminals of the second terminal set positioned such that a first plane defined by the first and third terminals is substantially parallel to a second plane defined by the second and fourth terminals and the fifth and sixth terminals of the third terminal set being spaced apart from the first and second planes.

20. The plunger switch of claim 19 wherein the first and sixth terminals are positioned substantially perpendicular to the first and second planes.

21. The plunger switch of claim 19 wherein the first and second planes are defined by portions of first, second, third and fourth terminals within the switch housing interior region.

22. The plunger switch of claim 19 wherein the first and second planes are defined by portions of the first, second, third and fourth terminals outside of the switch terminal housing.

23. The plunger switch of claim 19 wherein the first and second terminals of the first set of terminals are electrically coupled by engagement of the first wiper contact in the normal position of the plunger and are electrically isolated in the actuated position of the plunger.

24. The plunger switch of claim 19 wherein the third and fourth terminals of the second set of terminals are electrically coupled by engagement of the second wiper contact in the normal position of the plunger and are electrically isolated in the actuated position of the plunger.

25. The plunger switch of claim 19 wherein the fifth and sixth terminals of the third set of terminals are electrically coupled by engagement of the third wiper contact in the actuated position of the plunger and are electrically isolated in the normal position of the plunger.

26. The plunger switch of claim 19 wherein the terminals extend through openings in a terminal guide positioned in the interior region of the switch housing.

27. The plunger switch of claim 19 wherein the terminals comprise two offset substantially planar portions, a first planar portion being disposed within the switch housing interior region and a second planar portion being disposed outside the switch housing interior region.

28. The plunger switch of claim 23 wherein the first and second terminals each include a cut out portion configured such that the wiper contact is disengaged from the first wiper contact when the plunger is in the actuated position.

29. The plunger switch of claim 24 wherein the third and fourth terminals each include a cut out portion configured such that the wiper contact is disengaged from the second wiper contact when the plunger is in the actuated position.

30. A plunger switch comprising:

a) a switch housing for supporting components of the plunger switch;

b) a plunger extending into an interior region of the switch housing and being actuatable from outside the switch housing, the plunger adapted to move between a normal position and an actuated position;

c) first, second and third electrically conductive wiper contacts mounted to the plunger for movement with the plunger;

d) first, second and third sets of terminals extending into the switch housing interior region, the first set of terminals including a first terminal and a second terminal which are electrically coupled by engagement of the first wiper contact in one of the normal and actuated positions of the plunger, the second set of terminals including a third terminal and a fourth terminal which are electrically coupled by engagement of the second wiper contact in one of the normal and actuated positions of the plunger and the third set of terminals including a fifth terminal and a sixth terminal which are electrically coupled by engagement of the third wiper contact in one of the normal and actuated positions of the plunger;

e) the first, second, third and fourth terminals including outer surface portions that are substantially parallel, the outer surface portions of the first and third terminals being substantially aligned and the outer surface portions of the second and fourth terminals being substantially aligned; and f) the fifth and sixth terminals including outer surface portions that are substantially parallel and are transverse to the outer surface portions of the first, second, third and fourth terminals.

31. The plunger switch of claim 30 wherein the outer surface portions of the fifth and sixth terminals are substantially perpendicular to the outer surface portions of the first, second, third and fourth terminals.

32. The plunger switch of claim 30 wherein the substantially parallel outer surface portions of the first, second, third and fourth terminals are within the switch housing interior region and the transverse outer surface portions of the fifth and sixth terminals are within the switch housing interior region.

33. The plunger switch of claim 30 wherein the substantially parallel outer surface portions of the first, second, third and fourth terminals are outside the switch housing interior region and the transverse outer surface portions of the fifth and sixth terminals are outside the switch housing interior region.

34. The plunger switch of claim 30 wherein the first and second terminals of the first set of terminals are electrically coupled by engagement of the first wiper contact in the normal position of the plunger and are electrically isolated in the actuated position of the plunger.

35. The plunger switch of claim 30 wherein the third and fourth terminals of the second set of terminals are electrically coupled by engagement of the second wiper contact in the normal position of the plunger and are electrically isolated in the actuated position of the plunger.

36. The plunger switch of claim 30 wherein the fifth and sixth terminals of the third set of terminals are electrically coupled by engagement of the third wiper contact in the actuated position of the plunger and are electrically isolated in the normal position of the plunger.

37. The plunger switch of claim 30 wherein the terminals extend through openings in a terminal guide positioned in the interior region of the switch housing.

38. The plunger switch of claim 30 wherein the terminals comprise two offset substantially planar portions, a first planar portion being disposed within the switch housing interior region and a second planar portion being disposed outside the switch housing interior region.

39. A plunger switch and connector assembly comprising:

a) a plunger switch including a switch housing and a connector including a connector housing releasably engaging the switch housing;

b) the plunger switch including:

i) a switch housing for supporting components of the plunger switch;

ii) a plunger extending into an interior region of the switch housing and being actuatable from outside the switch housing, the plunger adapted to move between a normal position and an actuated position;

iii) first, second and third electrically conductive wiper contacts mounted to the plunger for movement with the plunger;

iv) first, second and third sets of terminals extending into the switch housing interior region, the first set of terminals including a first terminal and a second terminal which are electrically coupled by engagement of the first wiper contact in one of the normal and actuated positions of the plunger, the second set of terminals including a third terminal and a fourth terminal which are electrically coupled by engagement of the second wiper contact in one of the normal and actuated positions of the plunger and the third set of terminals including a fifth terminal and a sixth terminal which are electrically coupled by engagement of the third wiper contact in one of the normal and actuated positions of the plunger; and v) the first and second terminals of the first terminal set and the third and fourth terminals of the second terminal set positioned such that a first plane defined by the first and third terminals is substantially parallel to a second plane defined by the second and fourth terminals and the fifth and sixth terminals of the third terminal set being spaced apart from the first and second planes; and c) the connector including:

i) the connector housing for supporting components of the connector; and ii) first, second and third sets of terminals supported by the connector housing in spaced apart relationship and oriented to electrically contact the terminals of the first, second and third sets of terminals of the plunger switch when the plunger switch housing and the connector housing are engaged.

* * * * *